US006045007A

United States Patent [19]

Simmons

[11] Patent Number: 6,045,007

[45] Date of Patent: Apr. 4, 2000

[54] BEVERAGE DISPENSER CONFIGURATION

[75] Inventor: Darren Simmons, San Antonio, Tex.

[73] Assignee: Lancer Partnership, Ltd., San Antonio, Tex.

[21] Appl. No.: 09/131,495

[22] Filed: Aug. 10, 1998

[51] Int. Cl.[7] ..... B67D 5/62

[52] U.S. Cl. ..... 222/146.6; 222/129.1; 222/129.3; 141/82; 141/100; 141/105; 62/389; 62/390

[58] Field of Search ..... 222/129.1, 129.3, 222/129.4, 146.6; 141/82, 100, 105, 107; 62/389, 390

[56] References Cited

U.S. PATENT DOCUMENTS 4,304,736 12/1981 McMillan et al. ..... 261/35
5,730,330 3/1998 Reading ..... 222/129.1

*Primary Examiner*—Steven O. Douglas
*Assistant Examiner*—Timothy L. Maust
*Attorney, Agent, or Firm*—Christopher L. Makay

[57] ABSTRACT

A beverage dispenser includes a dispensing nozzle for dispensing product. A cooling system cools the product prior to communicating the cooled product to the dispensing nozzle. The beverage dispenser further includes a product source, and a flow controller positioned prior to the cooling system for regulating the delivery of product from the product source to the cooling system.

15 Claims, 2 Drawing Sheets

BEVERAGE DISPENSER CONFIGURATION

BACKGROUND OF THE INVENTION

1. Field of the Invention

The present invention relates to beverage dispensers and, more particularly, but not by way of limitation, to an improved beverage dispenser configuration that increases dispenser performance by increasing the number of beverages dispensed at a desired reduced temperature.

2. Description of the Related Art

FIG. 1 is a block diagram illustration of a prior art beverage dispenser 10. The beverage dispenser 10 includes a cooling chamber 11 having syrup coils 12 and a carbonation system 13 therein. The beverage dispenser 10 further includes a dispensing valve 14 mounted on the beverage dispenser 10 and connected to the syrup coils 12 and the carbonation system 13. Although not shown, the beverage dispenser 10 includes a refrigeration unit having an evaporator coil that extends into the cooling chamber 11 to maintain a cooling fluid within the cooling chamber 11 at approximately 32° F.

A syrup source 15 connects to the syrup coils 12 to deliver beverage syrup thereto for cooling prior to dispensing from the dispensing valve 14. The syrup source 15 may be either a figal or a bag in a box system. When the syrup source 15 is a bag in a box system, the beverage dispenser 10 includes a pump to deliver the syrup to the syrup coils 12.

A carbon dioxide gas source 16 and a water source 17 connect to the carbonation system 13 to deliver carbon dioxide gas and water thereto, respectively. Although not always necessary, the beverage dispenser 10 may include a pump to deliver the water into the carbonation system 13. The carbonation system 13 consists of a carbonator that forms carbonated water from the carbon dioxide gas and the water delivered therein from the carbon dioxide gas source 16 and the water source 17, respectively. The carbonation system 13 further consists of a waterline positioned either prior to the carbonator to pre-chill the water or placed after the carbonator to chill the carbonated water prior to delivery to the dispensing valve 14.

The dispensing valve 14 when activated opens to deliver a metered amount of carbonated water and syrup which are mixed in a dispensing nozzle prior to delivery into a cup. In delivering a metered amount of carbonated water and syrup, the dispensing valve 14 produces a beverage having a proper ratio of syrup and carbonated water.

Although beverage dispenser 10 operates adequately to deliver beverages at or below a desired temperature of 40° F. when the ambient temperature is less than 100° F., the beverage dispenser 10 will not consistently dispense beverages at or below the desired temperature of 40° F. when the ambient temperature rises above 100° F. The syrup coils 12 and the carbonation system 13 cool the syrup and carbonated water, respectively, to temperatures well below the desired dispensing temperature of 40° F. Unfortunately, the dispensing valve 14 resides outside the cooling chamber 11. Thus, when the beverage dispenser 10 is used "casually", a significant amount of syrup and carbonated water contained in the dispensing valve 14 and between the syrup coils 12 and carbonation system 13, respectively, are exposed and, therefore, heat to the ambient temperature. Consequently, upon the dispensing of a beverage, the heated syrup and carbonated water combines with the cooled syrup and carbonated water delivered from the syrup coils 12 and the carbonation system 13, respectively, to raise the temperature of the dispensed beverage outside of the desired temperate of 40° F.

Furthermore, even when the beverage dispenser 10 is used extensively such that syrup and carbonated water do not reside within the dispensing valve 14 for a time period sufficiently long for the syrup and carbonated water to heat to ambient temperature, the dispensing valve 14 itself heats to the ambient temperature so that cooled syrup and carbonated water passing therethrough absorbs heat from the dispensing valve 14 thereby raising the temperature of the dispensed beverage beyond the desired temperature of 40° F. Accordingly, the configuration of the beverage dispenser 10 is not optimal because it cannot consistently produce beverages at or below the desired temperature of 40° F. when the ambient temperature is above 100° F.

Thus, a beverage dispenser configuration that dispenses beverages at or below the desired temperature of 40° F. in environments where temperatures routinely exceed 100° F. will significantly improve over prior art beverage dispenser configurations.

SUMMARY OF THE INVENTION

In accordance with the present invention, a beverage dispenser includes a dispensing nozzle for dispensing product. A cooling system cools the product prior to communicating the cooled product to the dispensing nozzle utilizing a product tube having a minimum length. The beverage dispenser further includes a product source, and a flow controller positioned prior to the cooling system for regulating the delivery of product from the product source to the cooling system.

In another embodiment, a beverage dispenser includes a cooling system and a dispensing nozzle for dispensing a beverage. A syrup coil disposed in the cooling system communicates cooled syrup to the dispensing nozzle utilizing a syrup tube having a minimum length. A regulated mixing fluid source cooled by the cooling system communicates cooled mixing fluid to the dispensing nozzle. The beverage dispenser further includes a syrup source and a flow controller positioned prior to the syrup coil for regulating the delivery of syrup from the syrup source to the syrup coil.

The regulated mixing fluid source according to a first configuration includes a water line disposed in the cooling system for communicating cooled water to the dispensing nozzle utilizing a water tube having a minimum length. The regulated mixing fluid source further includes a water source and a flow controller positioned prior to the water line for regulating the delivery of water from the water source to the water line.

The regulated mixing fluid source according to a second configuration includes a water line disposed in the cooling system for communicating cooled water to the dispensing nozzle. A water source communicates water to the water line, and a flow controller positioned between the water line and the dispensing nozzle regulates the delivery of cooled water from the water line to the dispensing nozzle.

The regulated mixing fluid source according to a third configuration includes a carbonation system disposed in the cooling system for communicating cooled carbonated water to the dispensing nozzle utilizing a carbonated water tube having a minimum length. A carbon dioxide gas source communicates carbon dioxide gas to the carbonation system. The regulated mixing fluid source further includes a water source and a flow controller positioned prior to the carbonation system for regulating the delivery of water from the water source to the carbonation system.

The regulated mixing fluid source according to a final configuration includes a carbonation system disposed in the cooling system for communicating cooled carbonated water to the dispensing nozzle. A carbon dioxide gas source communicates carbon dioxide gas to the carbonation system. A water source communicates water to the carbonation system, and a flow controller positioned between the carbonation system and the dispensing nozzle regulates the delivery of cooled carbonated water from the carbonation system to the dispensing nozzle.

DETAILED DESCRIPTION OF THE PREFERRED EMBODIMENTS

Figure 1:
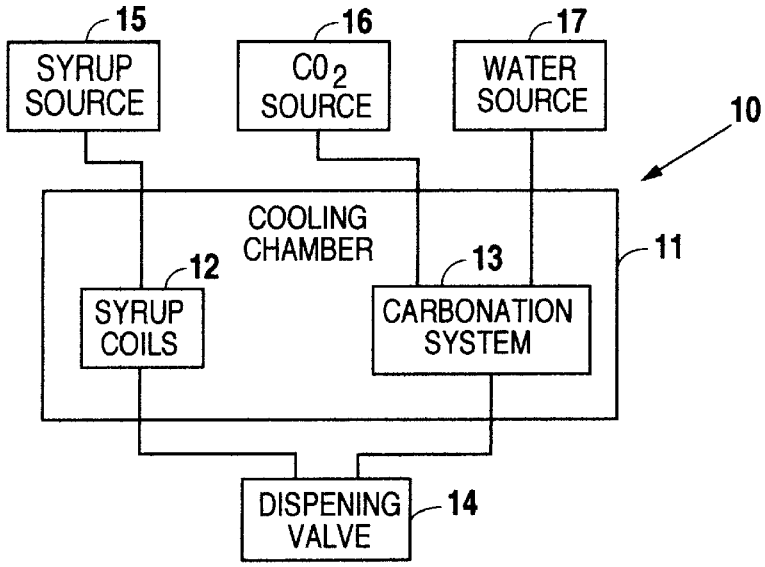
Fig. 1 (PRIOR ART)
FIG. 1 is a block diagram illustrating a prior art beverage dispenser configuration.
Figure 2:
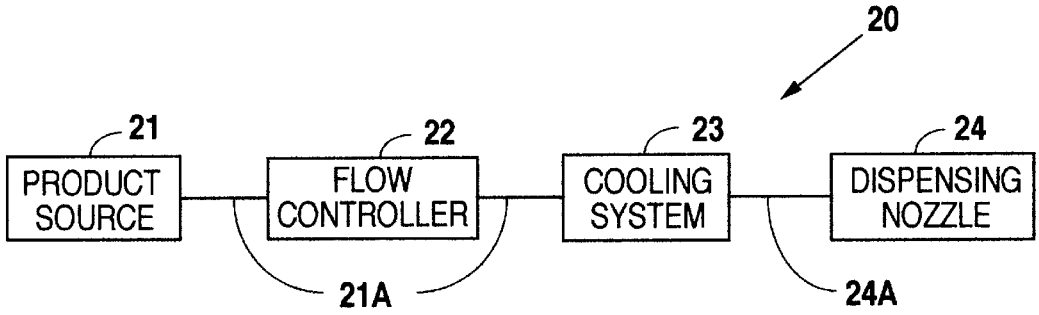
FIG. 2 is a block diagram illustrating a configuration for a beverage dispenser according to a preferred embodiment.

FIG. 2 illustrates a beverage dispenser 20 having a configuration that permits the dispensing of product, including the "casual" drink, at or below a temperature of 40° F., even when operated in ambient temperatures exceeding 100° F. The beverage dispenser 20 includes a product source 21, a flow controller 22, a cooling system 23, and a dispensing nozzle 24. The product source 21 may contain any suitable beverage, such as a carbonated or non-carbonated post-mix or pre-mix beverage, which is delivered using a figal or a bag in a box system. When a bag in a box system is utilized, the beverage dispenser 20 includes a product pump (not shown).

The flow controller 22 is positioned along a product line 21A to regulate the amount of product delivered from the product source 21 to the cooling system 23 and, thus, the amount of product dispensed from the dispensing nozzle 24. The flow controller 22 in this preferred embodiment is a valve operated either mechanically or electrically to permit product flow from the product source 21 to the cooling system 23. In particular, the valve is a solenoid valve opened in response to the depression and continued holding of a user activated switch, opened for a preset time period in response to a user activated switch, or opened in response to a user activated switch until a flow meter determines the product source 21 has delivered a desired amount of product. Although the preferred flow controller is a solenoid operated valve, one of ordinary skill in the art will recognize that mechanical flow controls, positive displacement flow controls, or modulated flow controls may be substituted.

The cooling system 23 includes a housing that defines a cooling chamber. The cooling chamber contains a cooling fluid, while the housing supports a platform having a refrigeration unit thereon. The refrigeration unit includes an evaporator coil that extends into the cooling chamber to create a cooling fluid bank for maintaining the cooling chamber at approximately 32° F. The cooling chamber further includes a product coil connected at an inlet to the product line 21A and at an outlet to the dispensing nozzle 24. Although not illustrated in the block diagram of FIG. 2, it should be understood by one of ordinary skill in the art that the flow controller 22 would mount onto the platform of the cooling system 23. Alternatively, the cooling system 23 may consist of an ice bin with a cold plate disposed therein or any other suitable means for cooling the product.

The dispensing nozzle 24 connects to the product coil of the cooling system 23 using a product tube 24A having a minimum length. The dispensing nozzle 24 delivers product from the product coil into a cup, and, in this preferred embodiment, the dispensing nozzle 24 is any suitable nozzle that directs product into a cup.

In operation, a user depresses a switch to open the flow controller 22 and, if necessary, activate a product pump of the beverage dispenser 20. With the flow controller 22 open, the product source 21 delivers product into the cooling coil of the cooling system 23. The product entering the cooling coil of the cooling system 23 displaces cooled product within the cooling coil, which travels from the cooling coil through the product tube 24A and out the dispensing nozzle 24 into a cup placed below. The flow controller 22 remains open to permit product flow depending upon its type. If the flow controller 22 is a solenoid valve controlled by the user, it remains open until the user releases the activating switch on the beverage dispenser 20. When the flow controller 22 is a solenoid valve operated for a preset time period, the beverage dispenser 20 includes an electronic control system that maintains the solenoid valve open until the expiration of the preset time. In the event the flow controller 22 is a solenoid valve used in combination with a flow meter, the beverage dispenser 20 includes an electronic control system that monitors the flow meter and deactivates the solenoid valve when the flow meter registers that the desired amount of product has been delivered from the product source 21.

The configuration of the beverage dispenser 20 illustrated in FIG. 2 improves over other beverage dispensers because the placement of the flow controller 22 prior to the cooling system 23 eliminates the problems experienced when dispensing valves are located after the cooling system. In the beverage dispenser 20, the product within the product source 21 is at ambient temperature because product sources are not typically refrigerated. Consequently, the product flowing from the product source 21, through the flow product line 21A and the controller 22, and to the cooling system 23 receives no additional heat from the flow controller 22 because the flow controller 22 is positioned prior to the cooling system 23 and the product is already at ambient temperature. The product line 21A delivers the product to the cooling system 23, which cools the product to a temperature below the 40° F. desired beverage dispensing temperature. The cooling system 23 delivers the product to the dispensing nozzle 24 via the product tube 24A. The minimum length of the product tube 24A is such that it does not impart a sufficient amount of heat to raise the product temperature above the 40° F. desired beverage dispensing temperature. Furthermore, the minimum length of the product tube 24A is such that it does not contain a sufficient amount of product therein to raise the product temperature above the 40° F. desired beverage dispensing temperature when the beverage dispenser 20 is used "casually". Accordingly, the beverage dispenser 20 easily dispenses beverages at or below the desired beverage dispensing temperature of 40° F., even when ambient temperature exceeds 100° F., due to the placement of the flow controller 22 prior to the cooling system 23 and the minimum length of the product tube 24A that delivers product to the dispensing nozzle 24.

Figure 3:
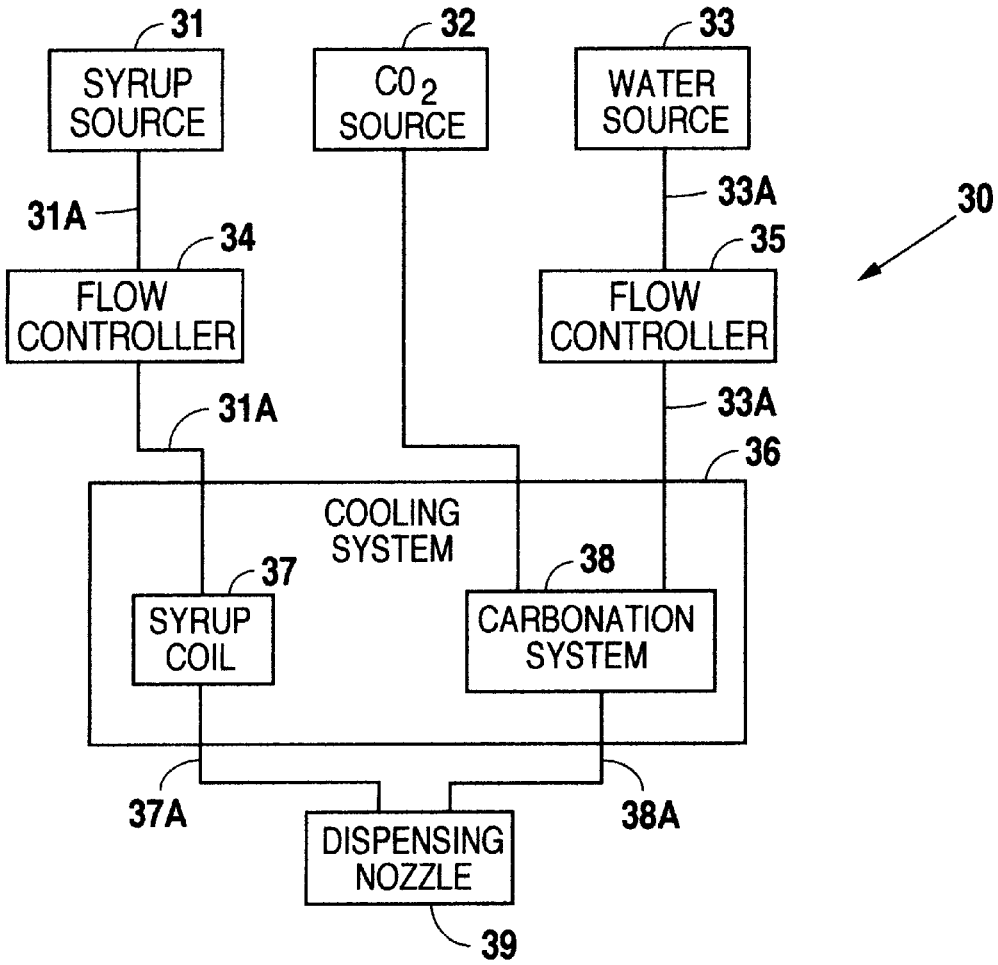
FIG. 3 is a block diagram illustrating a configuration for a beverage dispenser that dispenses carbonated beverages.

FIG. 3 illustrates a beverage dispenser 30 having a configuration that permits the dispensing of carbonated beverages, including the "casual" drink, at or below the desired dispensing temperature of 40° F., even when operated in ambient temperatures exceeding 100° F. The beverage dispenser 30 includes a syrup source 31, a syrup line 31A, a carbon dioxide gas source 32, a water source 33, flow controllers 34 and 35, a cooling system 36, a syrup coil 37, a carbonation system 38, and a dispensing nozzle 39. The syrup source 31 may contain any suitable beverage syrup, which is delivered using a figal or a bag in a box system. When a bag in a box system is utilized, the beverage dispenser 30 includes a syrup pump (not shown). The carbon dioxide gas source 32 connects to the carbonation system 38 to deliver carbon dioxide gas thereto. The water source 33, which is typically a municipal water line, connects to the carbonation system 38 via the water line 33A to deliver water thereto. If necessary, the beverage dispenser 30 may include a pump to deliver the water into the carbonation system 38. The carbon dioxide gas source 32, water source 33, water line 33A, flow controller 35, and carbonation system 38 form a regulated mixing fluid source for the beverage dispenser 30. Although the beverage dispenser 30 is configured to dispense carbonated beverages, one of ordinary skill in the art will recognize that carbon dioxide gas source 32 and the carbonation system 38 may be replaced with a water line disposed in the cooling system 36 so that the beverage dispenser 30 includes a regulated mixing fluid source for the dispensing of non-carbonated beverages.

The flow controller 34 is positioned along the syrup line 31A to regulate the amount of syrup delivered from the syrup source 31 to the syrup coils 37 and, thus, the amount of syrup dispensed from the dispensing nozzle 39. The flow controller 34 in this preferred embodiment is a valve operated either mechanically or electrically to permit product flow from the syrup source 31 to the syrup coils 37. In particular, the valve is a solenoid valve opened in response to the depression and continued holding of a user activated switch, opened for a preset time period in response to a user activated switch, or opened in response to a user activated switch and controlled by a flow meter associated with the flow controller 35. Although the preferred flow controller is a solenoid operated valve, one of ordinary skill in the art will recognize that mechanical flow controls, positive displacement flow controls, or modulated flow controls may be substituted.

The flow controller 35 is positioned along the water line 33A to regulate the amount of water delivered from the water source 33 to the carbonation system 38 and, thus, the amount of carbonated water dispensed from the dispensing nozzle 24. The flow controller 35 in this preferred embodiment is a valve operated either mechanically or electrically to permit water flow from the water source 33 to the carbonation system 38. In particular, the valve is a solenoid valve opened in response to the depression and continued holding of a user activated switch, opened for a preset time period in response to a user activated switch, or opened in response to a user activated switch until a flow meter determines the water source 33 has delivered a desired amount of water. Although the preferred flow controller is a solenoid operated valve, one of ordinary skill in the art will recognize that mechanical flow controls, positive displacement flow controls, or modulated flow controls may be substituted.

The cooling system 36 includes a cooling chamber that contains a cooling fluid and supports a platform having a refrigeration unit thereon. The refrigeration unit includes an evaporator coil that extends into the cooling chamber to create a cooling fluid bank for maintaining the cooling chamber at approximately 32° F. The syrup coil 37 resides in the cooling chamber and connects at an inlet to the syrup line 31A and at an outlet to the dispensing nozzle 39. The carbonation system 38 also resides in the cooling chamber and connects at a gas inlet to the carbon dioxide gas source 32, at a water inlet to the water line 33A, and at a carbonated water outlet to the dispensing nozzle 39. Although not illustrated in the block diagram of FIG. 3, it should be understood by one of ordinary skill in the art that the flow controllers 34 and 35 would mount onto the platform supported by the cooling chamber of the cooling system 36. Alternatively, the housing may contain a cold plate disposed therein or any other suitable means for cooling the syrup and carbonated water.

The carbonation system 38 consists of a carbonator that forms carbonated water from the carbon dioxide gas and the water delivered therein from the carbon dioxide gas source 32 and the water source 33, respectively. The carbonation system 38 further consists of a waterline positioned either prior to the carbonator to pre-chill the water or placed after the carbonator to chill the carbonated water prior to delivery to the dispensing nozzle 39.

The dispensing nozzle 39 connects to the syrup coil 37 using a syrup tube 37A having a minimum length. Similarly, the dispensing nozzle 39 connects to the carbonation system 38 using a carbonated water tube 38A having a minimum length. The dispensing nozzle 39 receives the syrup from the syrup coil 37 and the carbonated water from the carbonation system 38 and mixes the syrup and the carbonated water to form a carbonated beverage prior to delivering the carbonated beverage into a cup. In this preferred embodiment, the dispensing nozzle 24 is any suitable nozzle that mixes syrup and carbonated water to form a carbonated beverage prior to delivery into a cup.

In operation, a user depresses a switch to open the flow controllers 34 and 35 and, if necessary, activate a syrup pump and a water pump of the beverage dispenser 30. With the flow controller 34 open, the syrup source 31 delivers syrup into the syrup coil 37 via the syrup line 31A. The syrup entering the syrup coil 37 displaces cooled syrup within the syrup coil 37, which travels from the syrup coil 37, through the syrup tube 37A, and out the dispensing nozzle 39 into a cup placed below. Similarly, with the flow controller 35 open, the water source 33 delivers water to the carbonation system 38 via the water line 33A. The water entering the carbonation system 38 displaces carbonated water within the carbonation system 38, which travels from the carbonation system, through the carbonated water tube 38A, and out the dispensing nozzle 39 into a cup placed below. The flow controllers 34 and 35 remain open to permit syrup and carbonated water flow depending upon their type. If the flow controllers 34 and 35 are solenoid valves controlled by the user, they remain open until the user releases the activating switch on the beverage dispenser 30. When the flow controllers 34 and 35 are solenoid valves operated for a preset time period, the beverage dispenser 30 includes an electronic control system that maintains the solenoid valves open until the expiration of the preset time. In the event the flow controllers 34 and 35 are solenoid valves used in combination with a flow meter, the beverage dispenser 30 includes an electronic control system that monitors the flow meter and deactivates the solenoid valves when the flow meter registers that the desired amount of carbonated water has been delivered from the water source 33.

The configuration of the beverage dispenser 30 illustrated in FIG. 3 improves over other beverage dispensers because the placement of the flow controllers 34 and 35 prior to the syrup coil 37 and the carbonation system 38, respectively, eliminates the problems experienced when dispensing valves are located after the cooling system. In the beverage dispenser 30, the syrup within the syrup source 31 and the water within the water source 33 are at ambient temperature because syrup and water sources are not typically refrigerated. Consequently, the syrup flowing from the syrup source 31, through the syrup line 31A and the flow controller 34, and to the syrup coil 37 receives no additional heat from the flow controller 34 because the flow controller 34 is positioned prior to the syrup coil 37 and the syrup is already at ambient temperature. Similarly, the water flowing from the water source 33, through the water line 33A and the flow controller 35, and to the carbonation system 38 receives no additional heat from the flow controller 35 because the flow controller 35 is positioned prior to the carbonation system and the water is already at ambient temperature. The flow controller 34 delivers the syrup to the syrup coil 37, which cools the syrup to a temperature below the 40° F. desired beverage dispensing temperature. The flow controller 35 delivers the water to the carbonation system 38, which carbonates the water and cools the carbonated water to a temperature below the 40° F. desired beverage dispensing temperature. The syrup coil 37 and the carbonation system 38 deliver the syrup and carbonated water to the dispensing nozzle 39 via the syrup tube 37A and carbonated water tube 38A, respectively. The minimum lengths of the syrup and carbonated water tubes 37A,38A are such that they do not impart a sufficient amount of heat to raise the syrup and carbonated water temperatures above the 40° F. desired beverage dispensing temperature. Furthermore, the minimum lengths of the syrup and carbonated water tubes 37A,38A is such that they do not contain a sufficient amount of syrup and product therein to raise the syrup and carbonated water temperatures above the 40° F. desired beverage dispensing temperatures when the beverage dispenser 30 is used "casually". Accordingly, the beverage dispenser 30 easily dispenses beverages at or below the desired beverage dispensing temperature of 40° F., even when ambient temperature exceeds 100° F., due to the placement of the flow controller 34 and 35 prior to the syrup coil 37 and carbonation system 38 and the minimum lengths of the syrup and carbonated water tubes 37A,38A that deliver syrup and carbonated water to the dispensing nozzle 39.

The embodiment illustrated in FIG. 3 utilizes the flow controller 35 positioned prior to the carbonation system 38 because that is the optimal configuration for the beverage dispenser 30. Nevertheless, one of ordinary skill in the art will recognize that the placement of the flow controller 35 after the carbonation system 38 would lessen production complication without a significant reduction in the performance of the beverage dispenser 30. The performance of the beverage dispenser 30 would not be significantly diminished because the amount of carbonated water used to make a carbonated beverage is such that the amount of any carbonated water contained in a flow controller positioned after the carbonation system would be too small to significantly affect the overall dispensed temperature of a beverage.

Although the present invention has been described in terms of the foregoing embodiments, such description has been for exemplary purposes only and, as will be apparent to one of ordinary skill in the art, many alternatives, equivalents, and variations of varying degrees will fall within the scope of the present invention. That scope, accordingly, is not to be limited in any respect by the foregoing description, rather, it is defined only by the claims that follow.

I claim:

1. A beverage dispenser, comprising:

a dispensing nozzle for dispensing product;

a cooling system for cooling product, wherein the cooling system communicates cooled product to the dispensing nozzle;

a product source including means for delivering product therefrom;

a product line for communicating product from the product source to the cooling system; and a flow controller positioned along the product line and prior to the cooling system for regulating the delivery of product from the product source to the cooling system.

2. The beverage dispenser according to claim 1 wherein the cooling system communicates cooled product to the dispensing nozzle utilizing a product tube.

3. The beverage dispenser according to claim 2 wherein the product tube has a minimum length.

4. A beverage dispenser, comprising:

a dispensing nozzle for dispensing a beverage;

a cooling system;

a syrup coil disposed in the cooling system for communicating cooled syrup to the dispensing nozzle;

a regulated mixing fluid source cooled by the cooling system for communicating cooled mixing fluid to the dispensing nozzle;

a syrup source including means for delivering syrup therefrom;

a syrup line for communicating syrup from the syrup source to the syrup coil; and a flow controller positioned along the product line and prior to the syrup coil for regulating the delivery of syrup from the syrup source to the syrup coil.

5. The beverage dispenser according to claim 4 wherein the syrup coil communicates cooled syrup to the dispensing nozzle utilizing a syrup tube.

6. The beverage dispenser according to claim 5 wherein the syrup tube has a minimum length.

7. The beverage dispenser according to claim 4 wherein the regulated mixing fluid source comprises:

a water line disposed in the cooling system for communicating cooled water to the dispensing nozzle;

a water source; and a flow controller positioned prior to the water line for regulating the delivery of water from the water source to the water line.

8. The beverage dispenser according to claim 7 wherein the water line communicates cooled water to the dispensing nozzle utilizing a water tube.

9. The beverage dispenser according to claim 8 wherein the water tube has a minimum length.

10. The beverage dispenser according to claim 4 wherein the regulated mixing fluid source comprises:

a water line disposed in the cooling system for communicating cooled water to the dispensing nozzle;

a water source for communicating water to the water line; and a flow controller positioned between the water line and the dispensing nozzle for regulating the delivery of cooled water from the water line to the dispensing nozzle.

11. The beverage dispenser according to claim 4 wherein the regulated mixing fluid source comprises:

a carbonation system disposed in the cooling system for communicating cooled carbonated water to the dispensing nozzle;

a carbon dioxide gas source for communicating carbon dioxide gas to the carbonation system;

a water source; and a flow controller positioned prior to the carbonation system for regulating the delivery of water from the water source to the carbonation system.

12. The beverage dispenser according to claim 11 wherein the carbonation system communicates cooled carbonated water to the dispensing nozzle utilizing a carbonated water tube.

13. The beverage dispenser according to claim 12 wherein the carbonated water tube has a minimum length.

14. The beverage dispenser according to claim 4 wherein the regulated mixing fluid source comprises:

a carbonation system disposed in the cooling system for communicating cooled carbonated water to the dispensing nozzle;

a carbon dioxide gas source for communicating carbon dioxide gas to the carbonation system;

a water source for communicating water to the carbonation system; and a flow controller positioned between the carbonation system and the dispensing nozzle for regulating the delivery of cooled carbonated water from the carbonation system to the dispensing nozzle.

15. A method of enhancing the ability of a beverage dispenser to dispense a product at or below a desired temperature, comprising the steps of:

providing a dispensing nozzle for dispensing product;

providing a cooling system for the cooling product prior to delivery to the dispensing nozzle;

providing a product source including means for delivering product therefrom;

providing a product line for communicating product from the product source to the cooling system; and delivering product from a product source to the cooling system via the product line;

regulating the delivery of product from the product source to the cooling system utilizing a flow controller positioned along the product line and prior to the cooling system.

* * * * *